US005265349A

United States Patent [19]

Munschy

[11] Patent Number: 5,265,349

[45] Date of Patent: Nov. 30, 1993

[54] LENGTH ADJUSTABLE SCUFF

[76] Inventor: Dorothy G. Munschy, 1512 Locust Ravine, Bakersfield, Calif. 93306

[21] Appl. No.: 938,874

[22] Filed: Aug. 31, 1992

[51] Int. Cl.[5] ..... A43B 3/26

[52] U.S. Cl. ..... 36/97; 36/11.5; 36/105

[58] Field of Search ..... 36/11.5, 9 R, 9 A, 1, 36/97, 10, 105, 112

[56] References Cited

U.S. PATENT DOCUMENTS

| | | | |
|---|---|---|---|
| 2,062,909 | 12/1936 | Kenagy, Sr. et al. | 36/11.5 |
| 2,391,720 | 12/1945 | Ludwig | 36/11.5 X |
| 2,803,894 | 8/1957 | Morgan | 36/11.5 X |
| 3,762,075 | 10/1973 | Munschy | 36/97 |
| 4,136,468 | 1/1979 | Munschy | 36/97 |
| 4,783,909 | 11/1988 | Van Doren et al. | 36/68 |
| 5,127,170 | 7/1992 | Messina | 36/105 |

FOREIGN PATENT DOCUMENTS

| | | | |
|---|---|---|---|
| 2950695 | 6/1981 | Fed. Rep. of Germany | 36/97 |
| 2184233 | 12/1973 | France | 36/9 R |
| 2258138 | 9/1975 | France | 36/97 |

*Primary Examiner*—Steven N. Meyers
*Assistant Examiner*—BethAnne Cicconi
*Attorney, Agent, or Firm*—Beehler & Pavitt

[57] ABSTRACT

A length adjustable scuff formed of a fabric sole of sufficient length for at least a portion of its after-section to be folded back on top of the remaining portion of the after-section to provide a support for the wearer's heel and/or arch. The folded-over portion of the after-section may be adjustably retained in its disposition relative to the front section of the sole, either by a velcro type material or by an element securable in the vicinity of the toe of the scuff.

7 Claims, 4 Drawing Sheets 50
52
3
21
44
4
21
14
17
16
14a
54
4
21'
23
10
12
18
34
3

50
52
6
46
24
8
22
28
16a'
54
12
8
26
6

22
44
10
12

LENGTH ADJUSTABLE SCUFF

FIELD OF THE INVENTION

This invention relates generally to footwear and, particularly, to an adjustable size scuff which may be of the disposable type for use in hospitals, athletic facilities, aircraft and other places where ordinary street shoes would not be used, or as a substitute for such street footwear.

DESCRIPTION OF THE PRIOR ART

While many different types of adjustable footwear have been devised over the course of a number of decades, examples of which may be found in the present inventor's prior U.S. Pat. Nos. 3,762,075 and 4,136,468, as well as in patents cited in, and during the prosecution of the applications which have resulted in those patents, little, if any attention has been devoted to devising adjustable scuffs. Scuffs, of course, differ from other types of footwear in that they have no back walls to enclose the wearer's heel portions of the foot. Scuffs may be made of expensive materials, such as leather, to serve as footwear in the nature of bedroom slippers. As such, they are not intended to be discarded after one or a few uses. Each pair of scuffs of this type is made to adapt to a predetermined range of foot sizes.

Other scuffs, such as those which are given free to patrons of swimming pools and shower rooms in athletic facilities, are usually made of paper, with a thicker and more water-resistant type of paper forming the sole, and an attached vamp of a paper of lesser substance serving to cover the front end of the patron's foot. Such scuffs are quite clumsy and are intended to be discarded after even a short period of use. They provide little feeling of comfort to the average foot and serve only to insulate the foot from bacteria which may inhabit the pool deck, or shower and locker room floor. These latter types of scuffs are normally made of a single size so that a person with a small foot may find that a substantial portion of the heel area is dragged or flopped behind the wearer's foot as the wearer walks; or where the wearer has a large foot, a portion of the wearer's heel is unprotected as the wearer walks over the bacteria containing surface.

SUMMARY OF THE INVENTION

The present invention is directed to providing a scuff which not only may be manufactured inexpensively so that it may be disposable, but provides a reasonable degree of comfort to the wearer, both under foot, as well as because of the feature of length adjustability to enable it to accommodate a range of more usually found foot sizes, e.g. in the case of men's sizes 7–11 and, in the case of women's sizes 4–7.

These objects of the invention may be accomplished by forming the scuff of a comfortable fabric in a forward section and an after-section. A vamp in the form of a fabric stitched or otherwise secured to the sides of the forward section is provided to cover the instep and, optionally, the toes of the wearer's foot, or to leave the toes open. The bottoms of the forward and after sections may be covered with a thin sheet of an impervious flexible material, such as plastic. Such impervious layer, however, covers only the forward section and a portion of the after-section to a median foot length, thereby leaving uncovered a portion of the after section. Such portion may be folded back over the remaining and forward portion of the after-section to extend toward the forward section of the fabric sole. Adjustable means are provided to enable the wearer to extend the length of the after-section by unfolding back a portion of the folded over after section. The adjustable means may be in the form of a hook and fabric combination of the type commonly sold under the trademark VELCRO, or it may be in the form of a flexible element secured between the forward tip of the folded over portion of the after-section and the toe receiving area of the forward section. The flexible element may be passed through an open or closed toe type vamp to be secured externally of, and on the vamp.

In another embodiment of the invention, the flexible element in the form of an elastic strap or a strap of other types of material, may be attached at both its ends to the forward end of the folded over portion of the after-section to form a loop through which a cross strap may be passed and secured to both sides of the forward section. The impervious bottom sheet and the fabric may be stitched or glued together, as also may be the vamp similarly secured around the sides and front end of the forward section of the sole fabric.

With this construction, the scuff may be inexpensively fabricated and, because of the use of a fabric for the sole, depending upon the thickness of the fabric selected, much greater comfort may be afforded to the wearer's foot. The length adjustability feature of the invention enables the scuff to be used by most persons whose feet fall within the contemplated foot size range.

Notwithstanding these features, the scuff of the present invention may be so inexpensively fabricated that pairs of such scuffs may be given away without charge to patrons of air lines, hospital patients and others who may require or desire some type of foot covering other than street shoes during the period they remain in such facilities. Because the scuffs of the present invention may be given away, or purchased at a minimum of expense, the users may choose to discard them after a particular extent of use for which they are acquired.

Although certain institutions or industries may choose to give such scuffs away, because of their attractiveness, comfort and utility, they may also be offered for sale in gift shops, department stores, clothing and shoe stores, hotels and other establishments, for use in houses, cars, mobile homes and in other places.

DESCRIPTION OF THE DRAWINGS

In the accompanying drawings.

DESCRIPTION OF THE PREFERRED EMBODIMENT

Figure 1:
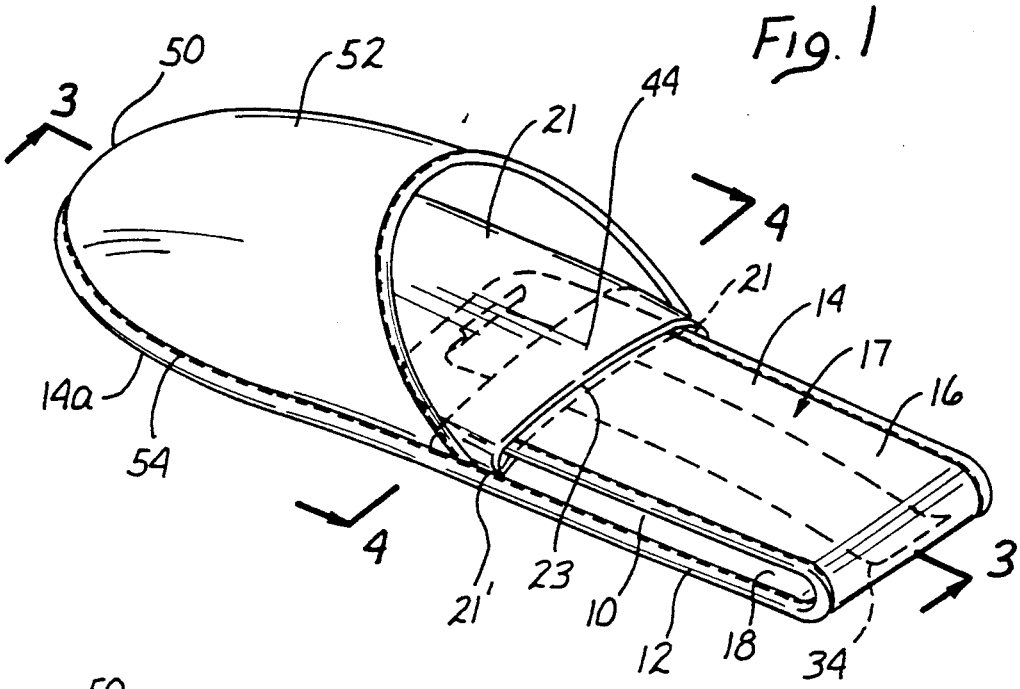
FIG. 1 is a perspective view of a scuff made in accordance with the present invention.
Figure 5:
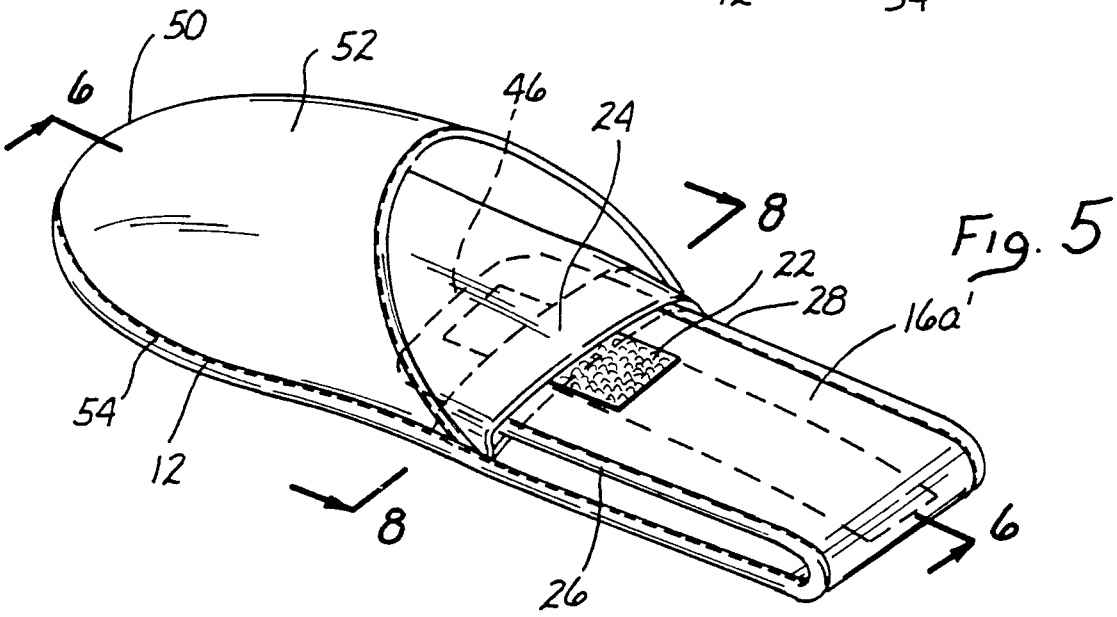
FIG. 5 is a perspective view, of another embodiment of the invention.
Figure 8:
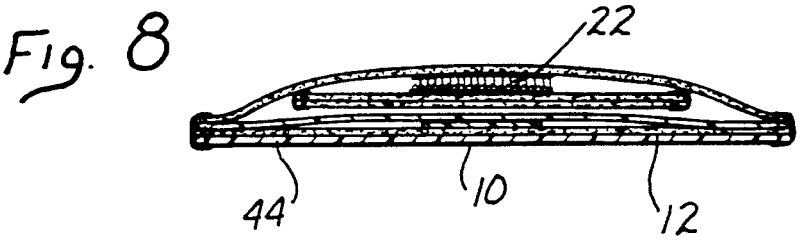
FIG. 8 is an enlarged section taken on the line 8—8 of FIG. 5.

Referring to FIGS. 1-4, the scuff in the preferred embodiment of the invention, may be formed by providing a foot shaped impervious under-sole 10 which may be formed of a light plastic material, such as polyethylene or polypropylene, onto which may be stitched or bonded a fabric 12 of substantially the same shape as the under-sole 10. The fabric 12 is of a greater length in its after section 14, such that its most rearwardly extent 16 may be folded back over the upper face 18 of the after-section 14, to form a tongue 17, as best shown schematically in FIG. 2. The extent of fold-over may be varied from the initial position shown in FIG. 2 in full lines to the dotted position shown at A.

In several embodiments of the invention, e.g. those of FIGS. 1-10, there is also provided a forward fabric pad 21 (FIG. 3) which is spaced from the topside of the forward section of the fabric sole 12 and secured along its side edges 21', 21", thereby forming a pocket 23 into and out of which the tongue 17 may be slipped.

Figure 3:
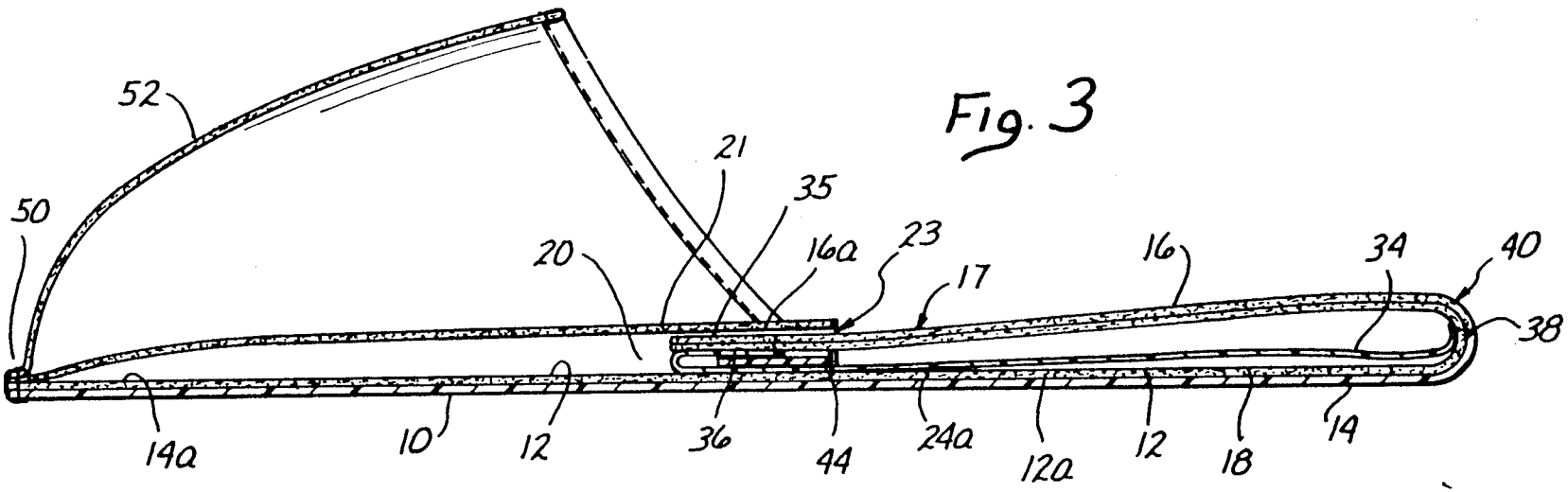
FIG. 3 is an enlarged section taken on the line 3—3 of FIG. 1.
Figure 4:
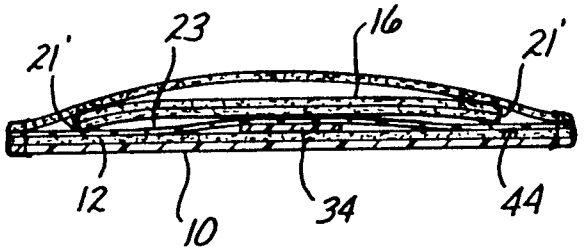
FIG. 4 is a section taken on the line 4—4 of FIG. 1.
Figure 2:
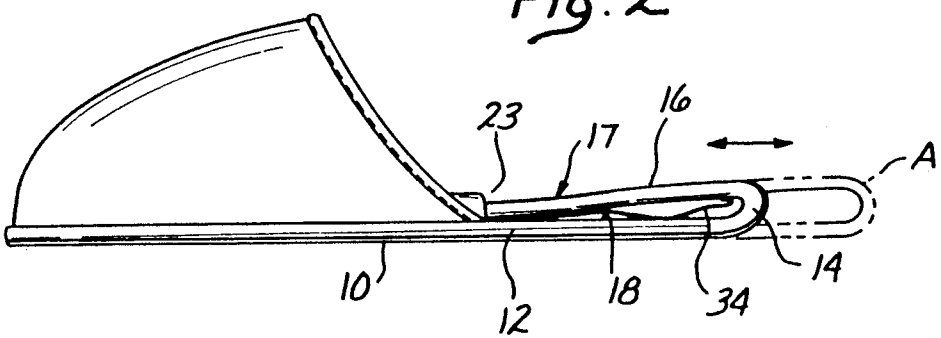
FIG. 2 is a side elevation of the scuff shown in FIG. 1 taken from the left side.
Figure 9:
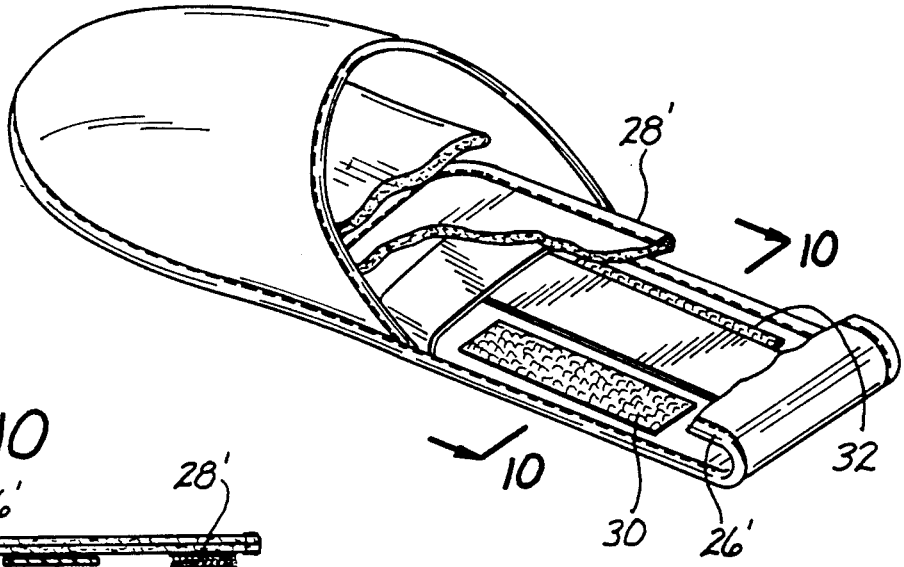
FIG. 9 is a perspective view, partly broken away, illustrating a still further embodiment of the invention.
Figure 10:
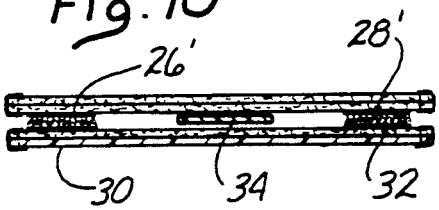
FIG. 10 is a section taken on the line 10—10 of FIG. 9

The extent of foldover of the portion 16 may, in the various embodiments, be determined by the disposition of the forward portion 16*a* in reference to the instep area 20 of the fabric 12. In the embodiments of FIGS. 5-10, this positioning may be determined by the extent to which the hook area (VELCRO patch 22) may be disposed in relationship to the interlocking fabric area 24. In the embodiment of FIGS. 5-8, the hooking strip 22 is centrally disposed with reference to the sides 26, 28 of the overlapping portion 16. In the embodiment of FIGS. 9 and 10, a pair of hooking element strips 30, 32 are spaced apart from each other laterally to extend below the sides 26' and 28' of the overlapping portion 16. In the embodiment of FIGS. 1-4, as shown in FIG. 3, an elastic or other type strip 34 is connected between the forward end 35 of the underside 36 of the overlapping portion 16*a* and a line 38 near the bend 40 of the overlapping portion 16*a*. This strip 34 is looped over a transverse flexible bridge 44 and held loosely in abutment with the upper face 42 of the after-section 24*a* of the fabric 12*a*.

Figure 6:
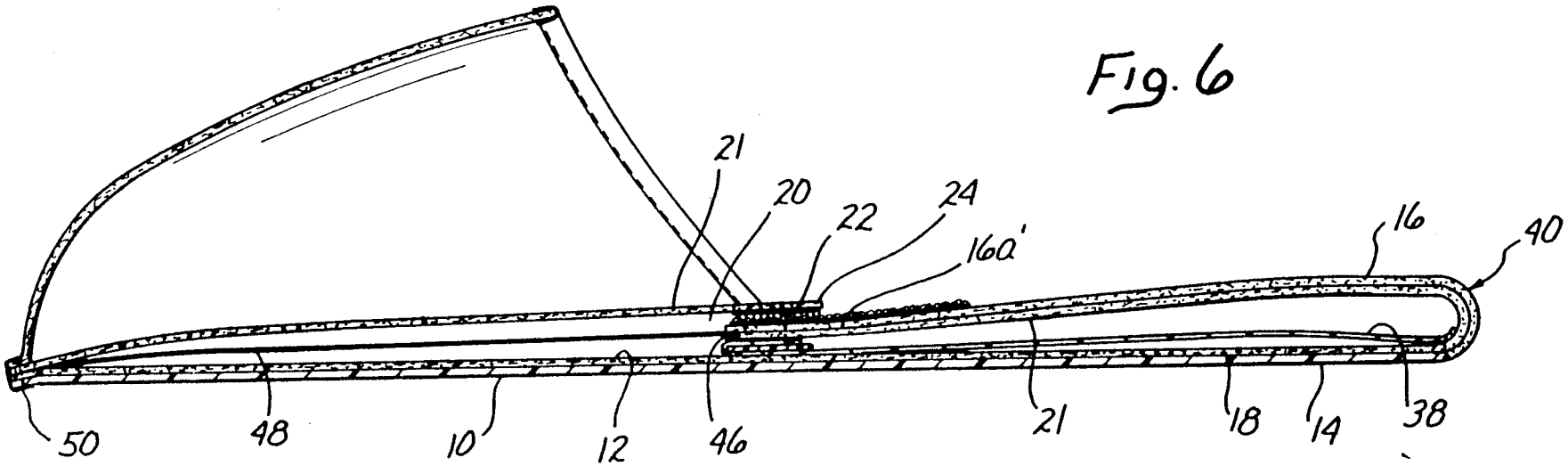
FIG. 6 is an enlarged section taken on the line 6—6 of FIG. 5.
Figure 7:
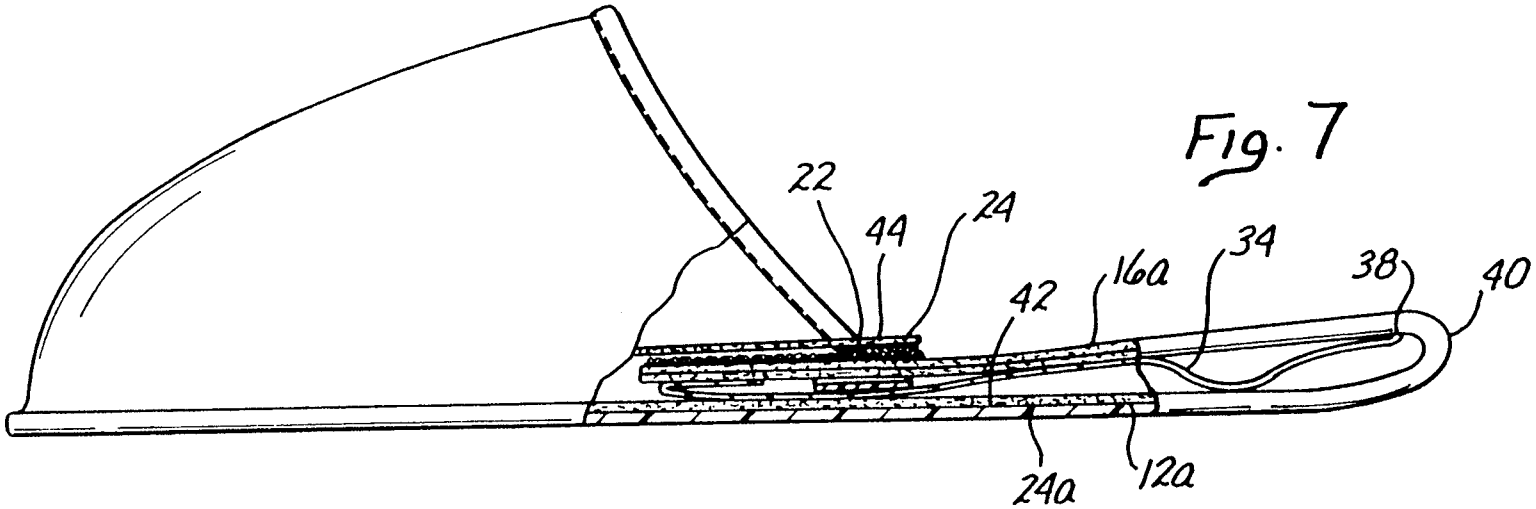
FIG. 7 is an enlarged section of the embodiment of FIG. 5 showing the scuff shortened by use of its adjustable means.

In the embodiment of FIGS. 5-8, as shown in FIG. 6, the forward tip 46 of the overlapping portion 16*a*' may be biased forward by a flexible element 48 in an area near the tip 50 of the scuff. However, when its hooking strip 22 is brought against the under face of the fabric pad 21, the overlapping portion 16*a*' will be secured in that position until released.

Figure 11:
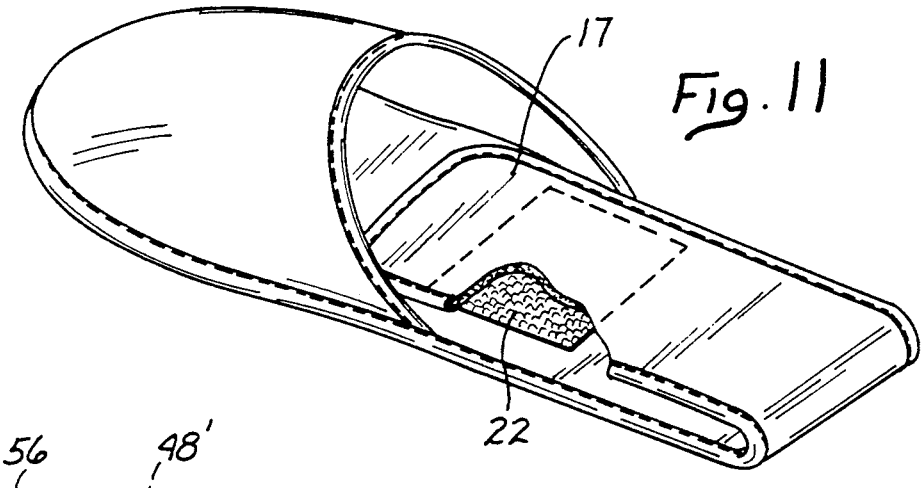
FIGS. 11 and 12 illustrate simplified embodiments of the invention.
Figure 12:
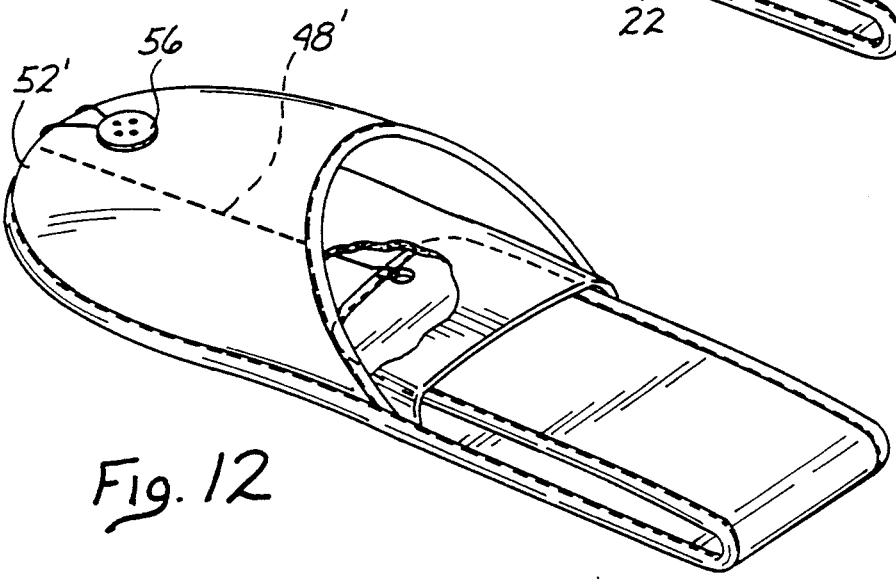

In the embodiments of FIGS. 11 and 12, the structures of the scuffs have been greatly simplified in that the fabric pad 21, the bridge 44 and the looped strip 34 have all been omitted. In the embodiment of FIG. 11, the tongue 17 is held in place by a hook and fabric combination 22, while in the embodiment of FIG. 12, it is held simply by a cord 48' passed through the vamp 52' and secured on a button 56 or other small retainer (not shown) on the outside of the vamp.

Desirably, in each of the embodiments of the invention, a vamp 52 is provided by stitching or gluing around the toe area 50 and the side 54 of the forward section 14*a* of the fabric (FIG. 1).

In use of the scuff, the portion 16 is folded over the upper face 24 of the rear section of the fabric 12 and secured by one of the adjustable means heretofore described. This fold-over serves initially to provide a scuff at the smaller end of the range of foot sizes to be accommodated. When it is desired to enable the scuff to accommodate a larger size foot, the fold-over portion 16 is, in effect, unfolded in the manner shown in FIG. 2 either by detaching the hook and fabric temporarily and then rejoining them, or, alternatively, simply pulling back the portion 16 against whichever flexible element, such as 34 or 48, serves to dispose the fold-over portion in its initial position.

It will be appreciated from a consideration of the foregoing description and the accompanying drawings, that an adjustable scuff to accommodate a range of foot sizes may readily be fabricated at either a minimum cost for disposable scuffs or at a greater cost for scuffs which are intended for extended usage.

I claim:

1. A length adjustable scuff comprising:

A sole, said sole being formed of a fabric and to the configuration of the underside of a human foot, said sole further having a forward section, and an after section joined to the forward section and extending rearwardly from the forward section, both said sections having upper and lower faces and having a total combined length in excess of what is required to insulate a foot of a minimum predetermined size disposed thereon from an underlying ground surface, the excess of the after section being folded forwardly over, and laid upon at least a portion of the upper face of the after section to form a tongue of substantially the same width as said upper face, means for adjustably securing said tongue initially in said folded over position on said upper face, but permitting said tongue to be partially unfolded rearwardly to increase the length of the after section to dispose more of its lower face on the ground surface; and a vamp extending over at least a portion of said forward section and secured along the side edges thereof.

2. The adjustable length scuff as described in claim 1 wherein the means for adjustably securing comprises an interlocking hook and fabric combination disposed between the upper face of the forward section and the underside of the tongue.

3. The adjustable length scuff as described in claim 2 wherein the hook and fabric combination is formed of two parallel side strips spaced from each other.

4. An adjustable length scuff as described in claim wherein the means for adjustably securing comprises a flexible element secured to the forward tip of the tongue, said flexible element being passed through the forward end of the vamp and secured externally of and on the vamp.

5. An adjustable length scuff as described in claim 1 wherein the means for adjustably securing comprises a flexible element attached to the forward tip of the tongue formed by the folded over portion of the after section, said flexible element being secured at the forward end and on the upper face of the forward section.

6. An adjustable length scuff as described in claim 1 wherein the means for adjustably securing comprises an elongated element both ends of which are secured to the end of the tongue to form a loop and a transverse strap is secured at its ends one to each side of the sole and passed through the loop.

7. The means for adjustably securing scuff as described in claim 1 wherein the means adjustably to secure the tongue comprises an interlockinghook and fabric combination disposed between the upper face of the after section and the underside of the tongue.

* * * * *